US006390308B1

(12) United States Patent
Ebrahim

(10) Patent No.: US 6,390,308 B1
(45) Date of Patent: May 21, 2002

(54) SCARF ORGANIZING DEVICE

(76) Inventor: Razia Ebrahim, 55 Dolomite Ave., Penlyn Estate, Lansdowne, Cape Town 7780 (ZA)

( * ) Notice: Subject to any disclaimer, the term of this patent is extended or adjusted under 35 U.S.C. 154(b) by 0 days.

(21) Appl. No.: 09/727,416

(22) Filed: Dec. 1, 2000

(51) Int. Cl.[7] ..... A47F 7/19

(52) U.S. Cl. ..... 211/85.3; 211/13.1; 211/100; 211/182

(58) Field of Search ..... 211/85.3, 182, 211/189, 13.1, 113, 116, 118, 60.1, 94.03, 105.1, 105.2, 96, 100; D6/315, 513, 317, 327, 328; 223/85, 88, 89–91, 42, 97

(56) References Cited

U.S. PATENT DOCUMENTS

| | | | | | |
|---|---|---|---|---|---|
| 1,266,333 | A | * | 5/1918 | Sholley | 211/182 |
| 1,530,407 | A | * | 3/1925 | Ranson | 211/100 |
| 2,647,643 | A | * | 8/1953 | Cruikshank | 211/100 |
| 2,875,903 | A | * | 3/1959 | Shrouds | 211/105.1 |
| 3,211,295 | A | * | 10/1965 | Weiss | 211/100 |
| 3,386,590 | A | * | 6/1968 | Gretz | 211/182 |
| 4,109,794 | A | * | 8/1978 | Samuel et al. | 211/13.1 |
| 4,136,784 | A | | 1/1979 | Knobel et al. | |
| 4,771,899 | A | | 9/1988 | Benedict et al. | |
| 4,972,961 | A | | 11/1990 | Roesch | |
| 5,054,628 | A | * | 10/1991 | Allen | 211/100 |
| D330,468 | S | | 10/1992 | Jester, Jr. | |
| D336,554 | S | | 6/1993 | Reeder | |
| 5,377,849 | A | * | 1/1995 | Martin | 211/13.1 |
| 5,657,887 | A | * | 8/1997 | Smith | 211/182 |
| 5,743,412 | A | * | 4/1998 | Noble | 211/182 |
| D407,564 | S | | 4/1999 | Wilcox | |
| 6,027,000 | A | * | 2/2000 | Sterzel et al. | 211/182 |

* cited by examiner

*Primary Examiner*—Daniel P. Stodola
*Assistant Examiner*—Jennifer E. Novosad

(57) ABSTRACT

A scarf organizing device for easily organizing and viewing an assortment of scarves in a drawer. The scarf organizing device includes a pair of mountings. Each of the mountings comprises a plate. The plate includes a first end, a second end, an upper surface and a lower surface. A pair of upstanding members that includes a first end and a second end is securably attached to the upper surface of the plate. Each of the upstanding members includes a bend therein. The second end of each of the upstanding members includes a hole extending therein. A perimeter shoulder is positioned generally adjacent to the second end of a first upstanding member. The device includes a plurality of hanging members. Each of the hanging members comprises a bracket. The bracket comprises a cylinder that includes a first end, a second end and a peripheral wall extending therebetween. The first and second ends include an aperture extending therethrough. A perimeter shoulder is positioned generally adjacent to the first end of the cylinder. An arced member is integrally coupled to and extends away from the peripheral wall of the cylinder. The device also includes a plurality of elongated members. The elongated members include a first end, a second end and a peripheral wall extending therebetween. The elongated members also include a bend therein. The arced member includes a size designed for receiving the first end of the elongated member.

6 Claims, 2 Drawing Sheets

SCARF ORGANIZING DEVICE

BACKGROUND OF THE INVENTION

1. Field of the Invention

The present invention relates to clothing apparel organizers and more particularly pertains to a new scarf organizing device for easily organizing and viewing an assortment of scarves in a drawer.

2. Description of the Prior Art

The use of clothing apparel organizers is known in the prior art. More specifically, clothing apparel organizers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,972,961; U.S. Pat. No. 4,771,899; U.S. Pat. No. 4,136,784; U.S. Pat. No. Des. 330,468; U.S. Pat. No. Des. 407,564; and U.S. Pat. No. Des. 336,554.

While these devices fulfill their respective, particular objectives and requirements, the aforementioned patents do not disclose a new scarf organizing device. The inventive device includes a pair of mountings. Each of the mountings comprises a plate. The plate includes a first end, a second end, an upper surface and a lower surface. A pair of upstanding members that includes a first end and a second end is securably attached to the upper surface of the plate. Each of the upstanding members includes a bend therein. The second end of each of the upstanding members includes a hole extending therein. A perimeter shoulder is positioned generally adjacent to the second end of a first upstanding member. The device includes a plurality of hanging members. Each of the hanging members comprises a bracket. The bracket comprises a cylinder that includes a first end, a second end and a peripheral wall extending therebetween. The first and second ends include an aperture extending therethrough. A perimeter shoulder is positioned generally adjacent to the first end of the cylinder. An arced member is integrally coupled to and extends away from the peripheral wall of the cylinder. The device also includes a plurality of elongated members. The elongated members include a first end, a second end and a peripheral wall extending therebetween. The elongated members also include a bend therein. The arced member includes a size designed for receiving the first end of the elongated member.

In these respects, the scarf organizing device according to the present invention substantially departs from the conventional concepts and designs of the prior art, and in so doing provides an apparatus primarily developed for the purpose of easily organizing and viewing an assortment of scarves in a drawer.

SUMMARY OF THE INVENTION

In view of the foregoing disadvantages inherent in the known types of clothing apparel organizers now present in the prior art, the present invention provides a new scarf organizing device construction wherein the same can be utilized for easily organizing and viewing an assortment of scarves in a drawer.

The general purpose of the present invention, which will be described subsequently in greater detail, is to provide a new scarf organizing device apparatus and method which has many of the advantages of the clothing apparel organizers mentioned heretofore and many novel features that result in a new scarf organizing device which is not anticipated, rendered obvious, suggested, or even implied by any of the prior art clothing apparel organizers, either alone or in any combination thereof.

To attain this, the present invention generally comprises a pair of mountings. Each of the mountings comprises a plate. The plate includes a first end, a second end, an upper surface and a lower surface. A pair of upstanding members that includes a first end and a second end is securably attached to the upper surface of the plate. Each of the upstanding members includes a bend therein. The second end of each of the upstanding members includes a hole extending therein. A perimeter shoulder is positioned generally adjacent to the second end of a first upstanding member. The device includes a plurality of hanging members. Each of the hanging members comprises a bracket. The bracket comprises a cylinder that includes a first end, a second end and a peripheral wall extending therebetween. The first and second ends include an aperture extending therethrough. A perimeter shoulder is positioned generally adjacent to the first end of the cylinder. An arced member is integrally coupled to and extends away from the peripheral wall of the cylinder. The device also includes a plurality of elongated members. The elongated members include a first end, a second end and a peripheral wall extending therebetween. The elongated members also include a bend therein. The arced member includes a size designed for receiving the first end of the elongated member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new scarf organizing device apparatus and method which has many of the advantages of the clothing apparel organizers mentioned heretofore and many novel features that result in a new scarf organizing device which is not anticipated, rendered obvious, suggested, or even implied by any of the prior art clothing apparel organizers, either alone or in any combination thereof.

It is another object of the present invention to provide a new scarf organizing device which may be easily and efficiently manufactured and marketed.

It is a further object of the present invention to provide a new scarf organizing device which is of a durable and reliable construction.

An even further object of the present invention is to provide a new scarf organizing device which is susceptible of a low cost of manufacture with regard to both materials and labor, and which accordingly is then susceptible of low prices of sale to the consuming public, thereby making such scarf organizing device economically available to the buying public.

Still yet another object of the present invention is to provide a new scarf organizing device which provides in the apparatuses and methods of the prior art some of the advantages thereof, while simultaneously overcoming some of the disadvantages normally associated therewith.

Still another object of the present invention is to provide a new scarf organizing device for easily organizing and viewing an assortment of scarves in a drawer.

Yet another object of the present invention is to provide a new scarf organizing device which includes a pair of mountings. Each of the mountings comprises a plate. The plate includes a first end, a second end, an upper surface and a lower surface. A pair of upstanding members that includes a first end and a second end is securably attached to the upper surface of the plate. Each of the upstanding members includes a bend therein. The second end of each of the upstanding members includes a hole extending therein. A perimeter shoulder is positioned generally adjacent to the second end of a first upstanding member. The device includes a plurality of hanging members. Each of the hanging members comprises a bracket. The bracket comprises a cylinder that includes a first end, a second end and a peripheral wall extending therebetween. The first and second ends include an aperture extending therethrough. A perimeter shoulder is positioned generally adjacent to the first end of the cylinder. An arced member is integrally coupled to and extends away from the peripheral wall of the cylinder. The device also includes a plurality of elongated members. The elongated members include a first end, a second end and a peripheral wall extending therebetween. The elongated members also include a bend therein. The arced member includes a size designed for receiving the first end of the elongated member.

Still yet another object of the present invention is to provide a new scarf organizing device that prevents scarves kept in a drawer from becoming wrinkled, requiring the need of ironing.

Even still another object of the present invention is to provide a new scarf organizing device that is can be taken on trips and used in existing drawers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
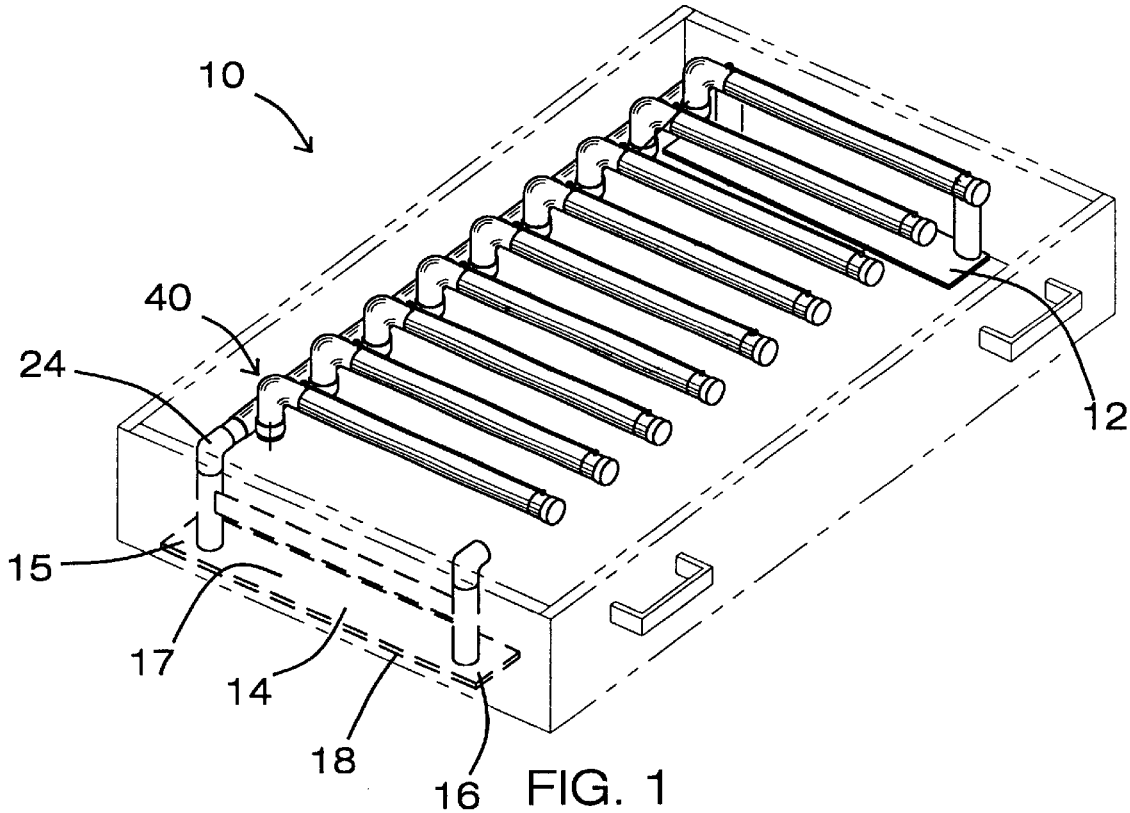
FIG. 1 is a schematic perspective view of a new scarf organizing device according to the present invention.
Figure 2:
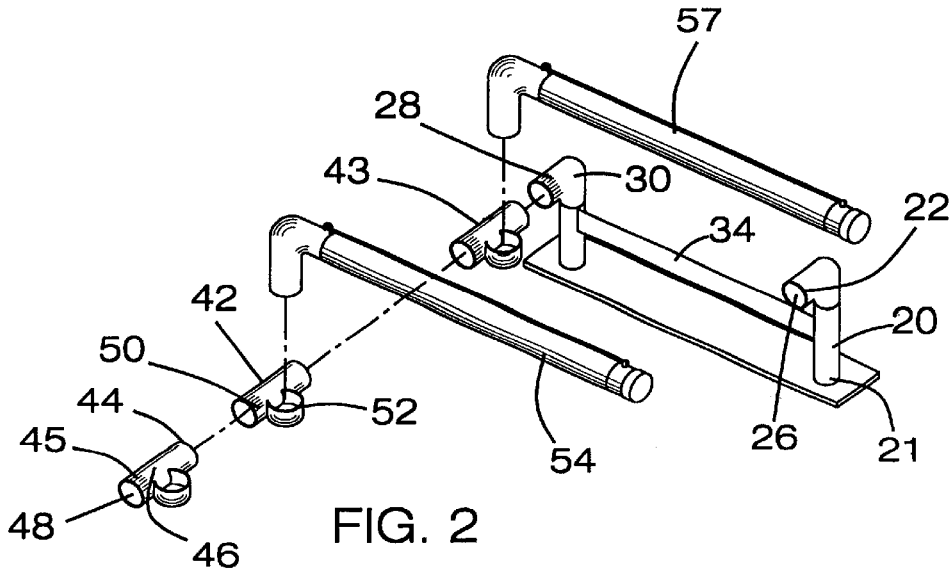
FIG. 2 is a schematic exploded view of the present invention showing a pair of upstanding members, brackets and a pair of elongated members.
Figure 3:
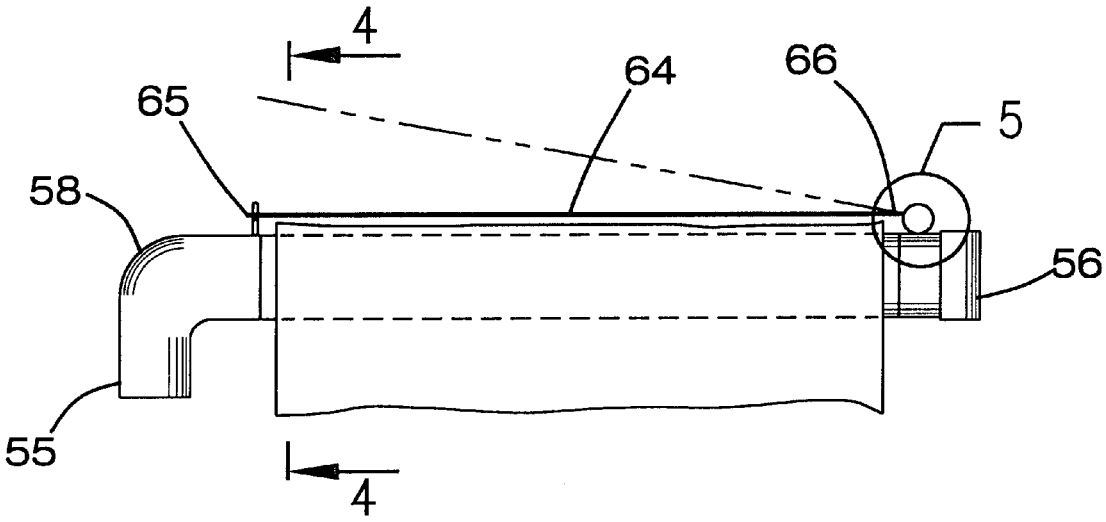
FIG. 3 is a schematic side view of the present invention showing a scarf hanging over an elongated member.
Figure 4:
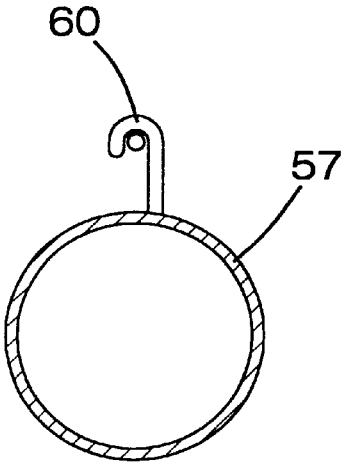
FIG. 4 is a schematic partial frontal view of the present invention showing a hook attached to an elongated member and a rod positioned in the hook.
Figure 5:
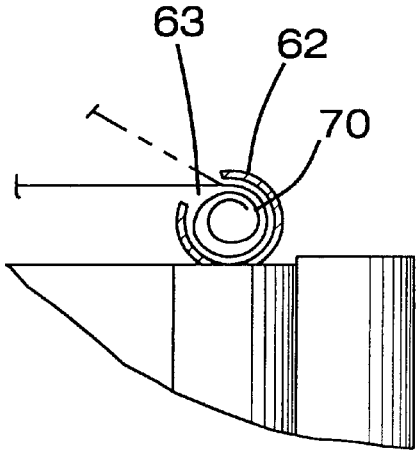
FIG. 5 is a schematic partial side view of the present invention showing a biasing means connected to an elongated member and a rod coupled to the biasing means.

With reference now to the drawings, and in particular to FIGS. 1 through 5 thereof, a new scarf organizing device embodying the principles and concepts of the present invention and generally designated by the reference numeral 10 will be described.

As best illustrated in FIGS. 1 through 5, the scarf organizing device 10 generally comprises a pair of mountings 12. Each of the mountings 12 comprises a plate 14. The plates 14 include a first end 15, a second end 16, an upper surface 17 and a lower surface 18.

Each plate 14 includes a pair of upstanding members 20. Each of the upstanding members 20 includes a first end 21 and a second end 22. The first end 21 of each of the upstanding members 20 is securably attached to and extending upwardly from the upper surface 17 of the plates 14. Each of the plates 14 comprises a substantially rigid material such as metal or plastic.

Each of the upstanding members 20 includes a bend 24 therein. The bend 24 of each of the upstanding members 20 is positioned generally nearer to the second end 22 of each of the upstanding members 20. The bends 24 are generally equal to a ninety-degree angle. The second end 22 of each of the upstanding members 20 includes a hole 26 extending therein. Each of the upstanding members 20 is positioned generally adjacent to an opposite end of the plates 14. A perimeter shoulder 28 is positioned generally adjacent to the second end 22 of a first upstanding member 30. The perimeter shoulder 28 is positioned generally between the second end 22 and the bend 24.

A supporting member 34 is integrally coupled and extending between each of the upstanding members 20. The supporting member 34 is positioned generally between the first end 21 and the bend 24 of each of the upstanding members 20. The supporting member 34 comprises a bar. The supporting member 34 provides support to the pair of upstanding members 20. The supporting member 34 generally comprises a substantially rigid material such as metal or plastic.

Connected to the upstanding members 20 is a plurality of hanging members 40. Each of the hanging members 40 comprises a bracket 42. Each of the brackets comprises a cylinder 43 that includes a first end 44, a second end 45 and a peripheral wall 46 extending therebetween. The first and second ends 44 and 45 include an aperture 48 extending therethrough.

A perimeter shoulder 50 is positioned generally adjacent to the first end 44 of the cylinder 43. The perimeter shoulder 50 allows each of the brackets 42 to releasably inter-connect. It also allows a bracket 42 to releasably interconnect with one of the upstanding members 20.

An arced member 52 is integrally coupled to and extending away from the peripheral wall 46 of the cylinder 43. The arced member 52 is positioned generally between the first and second ends 44 and 45 of the cylinder 43. The arced member 52 lies in a plane generally parallel to a longitudinal axis of the cylinder 43. The arced member 52 is comprised of a substantially rigid material such as plastic.

Releasably positionable in said arced member 52 is an elongated member 54. The elongated member 54 includes a first end 55, a second end 56 and a peripheral wall 57 extending therebetween. An outer surface of the peripheral wall 57 is designed for resisting a sliding of a scarf across the surface. The outer surface of the elongated member 54 may be coated with any material that increases the friction of a surface such as rubber or rough cloth material.

The elongated member 54 includes a bend 58 therein. The bend 58 is positioned generally adjacent to the first end 55. The bend 58 is substantially equal to ninety degrees. The arced member 52 includes a size designed for receiving the first end 55 of the elongated member 54. Each of the elongated members 54 has a length generally equal to the length of the plate 14.

A hook member 60 is integrally coupled to and extends upwardly away from the peripheral wall 57 of the elongated member 54. The hook member 60 is positioned generally adjacent to the bend 58 of the elongated member 54.

An annular member 62 is integrally coupled to the peripheral wall 57 of the elongated member 54. The annular member 62 is positioned generally adjacent to the second end 56 of the elongated member 54. The annular member 62 includes an opening 63 extending therein. The annular member 62 has a generally spherical shape with the opening 63 being positioned toward the first end 55 of the elongated member 54.

The hanging members also include a rod 64. The rod 64 includes a first end 65 and a second end 66. The hook member 60 includes a shape designed for releasably receiving the first end 65 of the rod.

A biasing means 70 designed for biasing the rod 64 away from the elongated member 54 is movably positionable in the opening 63 of the annular member 62. The biasing means 70 is integrally coupled to second end 66 of the rod 64. The rod 64 and biasing means 70 releasably secure a scarf to the elongated member 45.

In use the first end 44 of each of the bracket members 42 has a size designed for releasably receiving one of the second ends 45 of the bracket members 42. The hole 26 of each of the upstanding members 20 includes a size and shape designed for releasably receiving one of the first and second ends 44 and 45 of the brackets 42. The device may be interconnected with any combination of hanging members 40. The entire device is removably positionable in a conventional drawer.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A scarf organizing device for organizing scarves in a drawer, said device comprising:

a pair of mountings, each of said mountings comprising;

a plate, said plate having a first end, a second end, an upper surface and a lower surface;

a pair of upstanding members, each of said upstanding members having a first end and a second end, said first end of each of said upstanding members being securably attached to said upper surface of said plate, each of said upstanding members having a bend therein, said second end of each of said upstanding members having a hole extending therein, a perimeter shoulder being positioned generally adjacent to said second end of a first upstanding members;

a plurality of hanging members, each of said hanging members comprising;

a bracket, said bracket comprising;

a cylinder having a first end, a second end and a peripheral wall extending therebetween, said first and second ends having an aperture extending therethrough;

a perimeter shoulder being positioned generally adjacent to said first end of said cylinder;

an arced member, said arced member being integrally coupled to and extending away from said peripheral wall of said cylinder; and an elongated member, said elongated member having a first end, a second end and a peripheral wall extending therebetween, said elongated member having a bend therein, said arced member having a size adapted for receiving said first end of said elongated member.

2. The scarf organizing device of claim 1, further comprising a supporting member, said supporting member being integrally coupled and extending between each of said upstanding members, said supporting member being positioned generally between said first end and said bend of each of said upstanding members, said supporting member comprising a bar.

3. The scarf organizing device of claim 1, wherein said arced member is positioned generally between said first and second ends of said cylinder, said arced member lying in a plane generally parallel to a longitudinal axis of said cylinder, said arced member being comprised of a substantially rigid material.

4. The scarf organizing device of claim 1, further comprising:

an outer surface of said peripheral wall of said elongated member being adapted for resisting a sliding of a scarf across said outer surface.

5. The scarf organizing device of claim 1, further comprising:

a hook member, said hook member being integrally coupled to and extending upwardly away from said peripheral wall of said elongated member, said hook member being positioned generally adjacent to said bend of said elongated member;

an annular member being integrally coupled to said peripheral wall of said elongated member, said annular member being positioned generally adjacent to said second end of said elongated member, said annular member having a opening extending therein; and a rod, said rod having a first end and a second end, said hook having a shape adapted for releasably receiving said first end of said rod.

6. A scarf organizing device for organizing scarves in a drawer, said device comprising:

a pair of mountings, each of said mountings comprising;

a plate, said plate having a first end, a second end, an upper surface and a lower surface;

a pair of upstanding members, each of said upstanding members having a first end and a second end, said first end of each of said upstanding members being securably attached to and extending upwardly from said upper surface of said plate, each of said upstanding members having a bend therein, said bend of each of said upstanding members being positioned generally nearer to said second end of each of said upstanding members, said second end of each of said upstanding members having a hole extending therein, each of said upstanding members being positioned generally adjacent to an opposite end of said plate, a perimeter shoulder being positioned generally adjacent to said second end of a first one of said pair of upstanding members, said perimeter shoulder being positioned generally between said second end and said bend;

a supporting member, said supporting member being integrally coupled and extending between each of said upstanding members, said supporting member being positioned generally between said first end and said bend of each of said upstanding members, said supporting member comprising a bar;

a plurality of hanging members, each of said hanging members comprising;

a bracket, said bracket comprising;

a cylinder having a first end, a second end and a peripheral wall extending therebetween, said first and second ends having an aperture extending therethrough;

a perimeter shoulder being positioned generally adjacent to said first end of said cylinder;

an arced member, said arced member being integrally coupled to and extending away from said peripheral wall of said cylinder, said arced member being positioned generally between said first and second ends of said cylinder, said arced member lying in a plane generally parallel to a longitudinal axis of said cylinder, said arced member being comprised of a substantially rigid material;

an elongated member, said elongated member having a first end, a second end and a peripheral wall extending therebetween, an outer surface of said peripheral wall being adapted for resisting a sliding of a scarf across said outer surface, said elongated member having a bend therein, said bend being positioned generally adjacent to said first end, said bend being substantially equal to ninety degrees, said arced member having a size adapted for receiving said first end of said elongated member;

a hook member, said hook member being integrally coupled to and extending upwardly away from said peripheral wall of said elongated member, said hook member being positioned generally adjacent to said bend of said elongated member;

an annular member being integrally coupled to said peripheral wall of said elongated member, said annular member being positioned generally adjacent to said second end of said elongated member, said annular member having an opening extending therein; and a rod, said rod having a first end and a second end, said hook having a shape adapted for releasably receiving said first end of said rod;

wherein said first end of each of said bracket has a size adapted for releasably receiving one of said second ends of said bracket, said hole of each of said upstanding members having a size and shape adapted for releasably receiving one of said first and second ends of said brackets.

* * * * *